United States Patent [19]

Mariën et al.

[11] 4,367,381

[45] Jan. 4, 1983

[54] SWITCH FOR HIGH VOLTAGES

[75] Inventors: Pieter Mariën, De Meeren; Gijsberg W. Irik, Bilthoven; Rintje Boersma, Harmelen, all of Netherlands

[73] Assignee: Cog B.V., Utrecht, Netherlands

[21] Appl. No.: 886,461

[22] Filed: Mar. 14, 1978

[30] Foreign Application Priority Data

Apr. 19, 1977 [NL] Netherlands ..... 04277

[51] Int. Cl.[3] ..... H01H 31/24

[52] U.S. Cl. ..... 200/48 A; 200/48 R

[58] Field of Search ..... 200/48 A, 48 R

[56] References Cited

U.S. PATENT DOCUMENTS 3,801,768 4/1974 Meyer ..... 200/48 R

FOREIGN PATENT DOCUMENTS 619442 9/1935 Fed. Rep. of Germany .... 200/48 R 136432 9/1972 Netherlands ..... 200/48 R

*Primary Examiner*—Steven L. Stephan

*Attorney, Agent, or Firm*—Diller, Ramik & Wight

[57] ABSTRACT

A switch for high voltages comprising co-operating fixed and movable spherical contacts, of which the or each fixed contact consists of a stationary body in the shape of a hollow spherical cap and a potential field controlling screen adapted to be forced by the respective movable contact into said hollow cap, said screen being spherically complementary to said spherical cap, when the switch is in its open condition, and being also provided with the contact surfaces to conduct the main current.

7 Claims, 7 Drawing Figures

Figure 1:
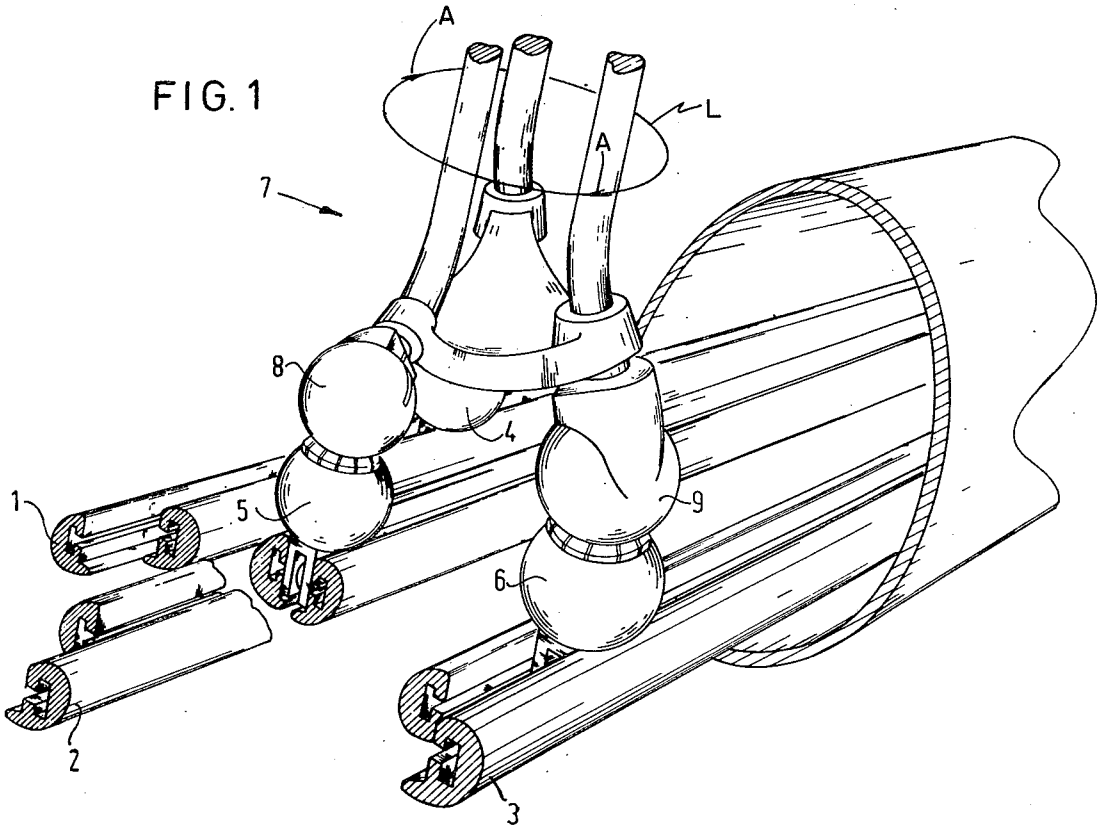

FIG. 2b
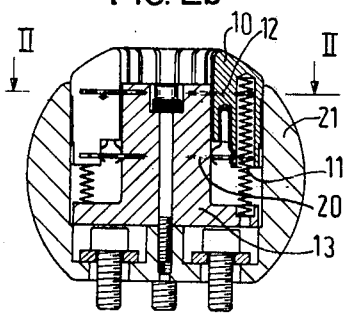
FIG. 2a
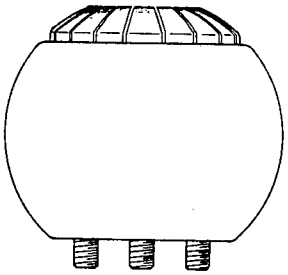
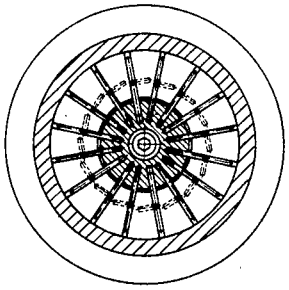
FIG. 2c
FIG. 3
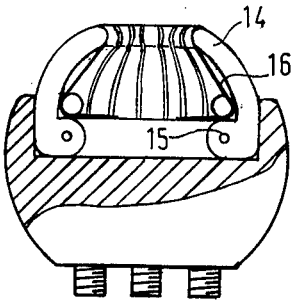
FIG. 4
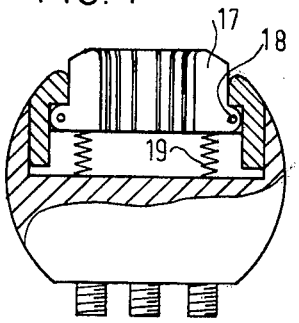

SWITCH FOR HIGH VOLTAGES

The invention relates to a switch for high voltages comprising at least one spherical, stationary contact and a spherical, movable contact co-operating therewith said stationary contact having a segment-shaped recess on the side facing the movable contact when the latter is in its on-position, said recess being covered in the off-condition of the switch by an electrically conductive potential screen complementing the spherical shape and occupying a position inside the sphere in the on-condition of the switch. Such a switch is known from Dutch Pat. No. 136,432 to which U.S. Pat. No. 3,657,504 corresponds.

In this known switch a contact member is mounted in the stationary contact next to the potential screen. The contact member may be annular and is engaged by a contact pin provided on the movable contact. In order to obtain between contact pin and contact member a sufficiently large contact surface to satisfy the requirements accurate positioning of the movable contact with respect to the fixed contact is required. Therefore, in the case of a rotatable contact the angle of rotation from the off-position to the on-position should be very accurately defined. Moreover, the permitted tolerances of the connection of the movable contact with the guiding arm and of that of the fixed contact with the voltage bar are very limited.

The object of the invention is to obviate the aforesaid disadvantages. According to the invention this is achieved in that the contact surface of the stationary contact intended to conduct the main current is formed by the potential screen. The measure according to the invention makes it possible to obtain a sufficiently large contact surface between the movable contact and the stationary contact at considerably less accurate positioning. This is particularly so when in a preferred embodiment the contact surface is formed by one or more contact fingers movable parallel to themselves and to one another. The contact fingers are relatively independently movable and the extent of the movement of the contact fingers towards the inside of the sphere is, therefore, completely determined by the position of the stationary contact with respect to the movable contact. The contact fingers may be arranged so that the or each contact finger is movable only in a direction at right angles to the base plane of the spherical segment. The potential screen may also consist of one or more pivotable contact fingers. The pivot of the or each contact finger may then be located near the spherical surface of the stationary contact. This construction of the potential screen is particularly advantageous when employed in a switch, in which the movable contact is adapted to move parallel to the base plane of the ball-segment-shaped recess of the stationary contact.

The invention will be elucidated more fully with reference to embodiments shown in the accompanying drawing.

Figure 5:
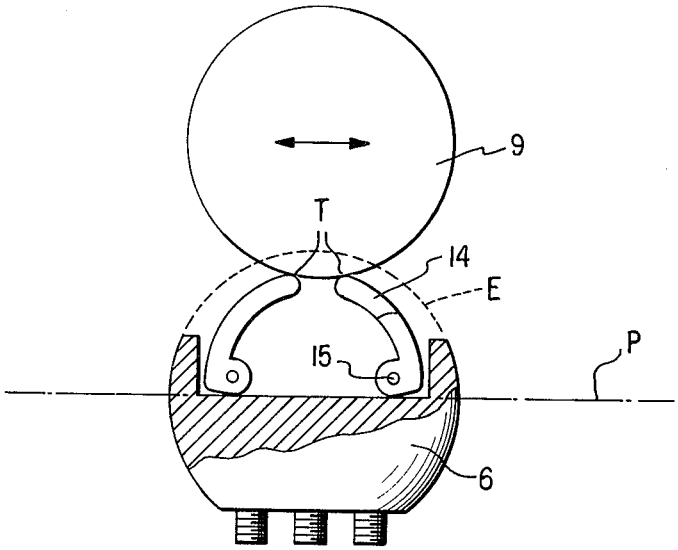

In the drawing:

FIG. 1 is a sectional elevational view of a switch in accordance with the invention, FIG. *2a* is an elevational view of the stationary contact in accordance with the invention, FIG. *2b* is a sectional elevational view of the contact shown in FIG. *2a*, FIG. *2c* is an elevational, sectional view taken on the line II—II in FIG. *2b*, FIG. 3 is a sectional elevational view of a further embodiment of the stationary contact, FIG. 4 is a sectional elevational view of a third embodiment of the invention, and FIG. 5 is a diagrammatic view illustrating certain principles of the invention.

The voltage bars 1,2 and 3 (FIG. 1) associated with the three phases of a multiphase busbar system are provided with the respective stationary contacts 4,5, and 6 of the isolator switch 7. The isolator switch is adapted to move from the closed position, as shown, to the opened position by turning in the direction indicated by arrows A. As noted above, each contact is adapted to move parallel to the base plane of the ball-segment-shaped recess of its associated stationary contact. Such a base plane is illustrated at P in FIG. 5 and, for each stationary contact 4, 5, 6, such base plane is of consequence parallel to the plane within which the direction line L in FIG. 1 lies. In the closed position a connection is established between the movable spherical contact and the associated stationary contact, for example, contacts 8 and 5; 9 and 6. The stationary contact comprises a potential screen serving also to conduct the main current. The stationary contact of FIG. 2 comprises a plurality of contact fingers 10 approaching together the spherical shape, said fingers being movable parallel to themselves and to one another in a direction at right angles to the base plane P of the spherical segment. Each contact finger, for example 10, has a reset spring 11. The fingers are guided by pins, for example 12. Arranged centrally between the contact fingers is an intermediate piece 13 of synthetic resin. The current path extends through the fingers 10 to the housing 21, whilst the spring 20 bearing on the intermediate piece 13 provides the required contact pressure.

In the embodiment shown in FIG. 3 the contact fingers are pivoted about an axis. The contact finger 14 is pivoted about the axis 15 and is biassed by a reset spring 16.

In the embodiment shown in FIG. 4 the contact fingers are also pivoted about an axis. The contact finger 17 is adapted to swing about the axis 18 and is loaded by the reset spring 19.

FIG. 5 illustrates how the potential screen of a stationary contact cooperates with a movable contact. The fingers 14 are as shown in FIG. 3, being movable about their axes 15. The movable contact 9, being movable back and forth as indicated by the double arrow direction line parallel to the plane P and that of line L in FIG. 1, engages the tips T of the fingers to swing them inwardly within the envelope E. The envelope E is the spherical extension of the body 6. The tips T normally lie in a plane parallel to plane P and on or substantially on such envelope as will be evident from FIG. 3. However, when the movable contact engages them as shown in FIG. 5, the tips T are depressed inwardly of the envelope E and lie in a plane, again parallel to the plane P, and on the contact 9.

What we claim is:

1. A switch for high-voltages comprising at least one stationary contact having a spherical envelope and a spherical movable contact co-operating therewith, said stationary contact having a recess and the movable contact being movable between an on-position registering with said recess and an off-position out of registry with said recess, said recess being covered in the off-condition of the switch by an electrically conductive potential screen complementing the spherical envelope of said stationary contact and occupying a position inside such envelope in the on-condition of the switch, the contact surface of the stationary contact intended to conduct the main current being formed by the potential screen, the contact surface being formed by one or more elongate and independently movable contact fingers.

2. A switch for high-voltages comprising at least one stationary contact having a spherical envelope and a spherical movable contact co-operating therewith, said stationary contact having a recess and the movable contact being movable between an on-position registering with said recess and an off-position out of registry with said recess, said recess being covered in the off-condition of the switch by an electrically conductive potential screen complementing the spherical envelope of said stationary contact and occupying a position inside such envelope in the on-condition of the switch, the contact surface of the stationary contact intended to conduct the main current being formed by the potential screen, the potential screen consisting of one or more pivoted contact fingers.

3. A high voltage switch comprising, in combination:

a stationary contact and a movable contact adapted to move in a direction parallel to a first plane into and out of contact with said stationary contact;

said stationary contact having a part-spherical surface defining a spherical envelope, said surface having a recess facing said first plane and including a plurality of fingers projecting out of said recess toward said plane and terminating in tips which normally lie essentially on said spherical envelope within a second plane parallel to said first plane, said fingers being individually movable inwardly away from said envelope and including means for resiliently biassing said fingers toward said first plane; and said movable contact being of part-spherical form presenting a spherical contact surface movable parallel to said first plane into and out of contact with the tips of said fingers, said spherical contact surface engaging said tips to force them inwardly such that said second plane is shifted inwardly of said spherical envelope.

4. A high voltage switch as defined in claim 3 wherein said fingers are arranged in an annular group whereby said tips lies along a circle in said second plane.

5. A high voltage switch as defined in claim 4 wherein said fingers are slidable in a direction normal to said first and second planes.

6. A high voltage switch as defined in claim 4 wherein said fingers are pivotally mounted remote from said tips thereof about axes parallel to said planes.

7. A high voltage switch comprising, in combination:

a stationary contact and a movable contact adapted to move in a direction parallel to a first plane into and out of contact with said stationary contact;

said stationary contact comprising a body having a recess extending in a direction normal to said first plane and including a plurality of contact fingers projecting out of said recess toward said first plane and terminating in tips which normally lie along a circle within a second plane parallel to said first plane, said fingers being movable inwardly away from said first plane and including means for resiliently biassing said fingers toward said first plane; and said movable contact having a spherical contact surface movable parallel to said first plane into and out of contact with the tips of said fingers, said spherical contact surface engaging said tips for forcing them inwardly such that said second plane is shifted away from said first plane.

* * * * *